United States Patent [19]

Norita et al.

[11] 3,971,705

[45] July 27, 1976

[54] METHOD OF PRODUCING CHAR FROM PULP MANUFACTURING WASTE LIQUOR

[75] Inventors: Toshimasa Norita, Tokyo; Hisato Ibara, Kawasaki; Masahiro Murakami; Masao Okano, both of Tokyo, all of Japan

[73] Assignee: Sanyo-Kokusaku Pulp Co., Ltd., Tokyo, Japan

[22] Filed: Apr. 17, 1974

[21] Appl. No.: 461,643

[30] Foreign Application Priority Data

Aug. 10, 1973 Japan ..... 48-89203

[52] U.S. Cl. ..... 201/2.5; 201/25; 201/32; 202/117; 162/16

[51] Int. Cl.[2] ..... C10B 47/18

[58] Field of Search ..... 201/2.5, 25, 32; 162/30–36; 202/117

[56] References Cited

UNITED STATES PATENTS

| | | | |
|---|---|---|---|
| 2,334,620 | 11/1943 | Goodell | 201/2.5 |
| 3,398,058 | 8/1968 | Campbell | 201/32 X |
| 3,705,077 | 12/1972 | Franz et al. | 201/25 |

*Primary Examiner*—Wilbur L. Bascomb, Jr.
*Attorney, Agent, or Firm*—Oblon, Fisher, Spivak, McClelland & Maier

[57] ABSTRACT

Char from the waste liquor of a pulp manufacturing process is produced by confining the waste liquor in a container and feeding the container into an air heating furnace in a manner such that the container is contacted countercurrently with heated air without rotating or stirring the container.

4 Claims, 1 Drawing Figure

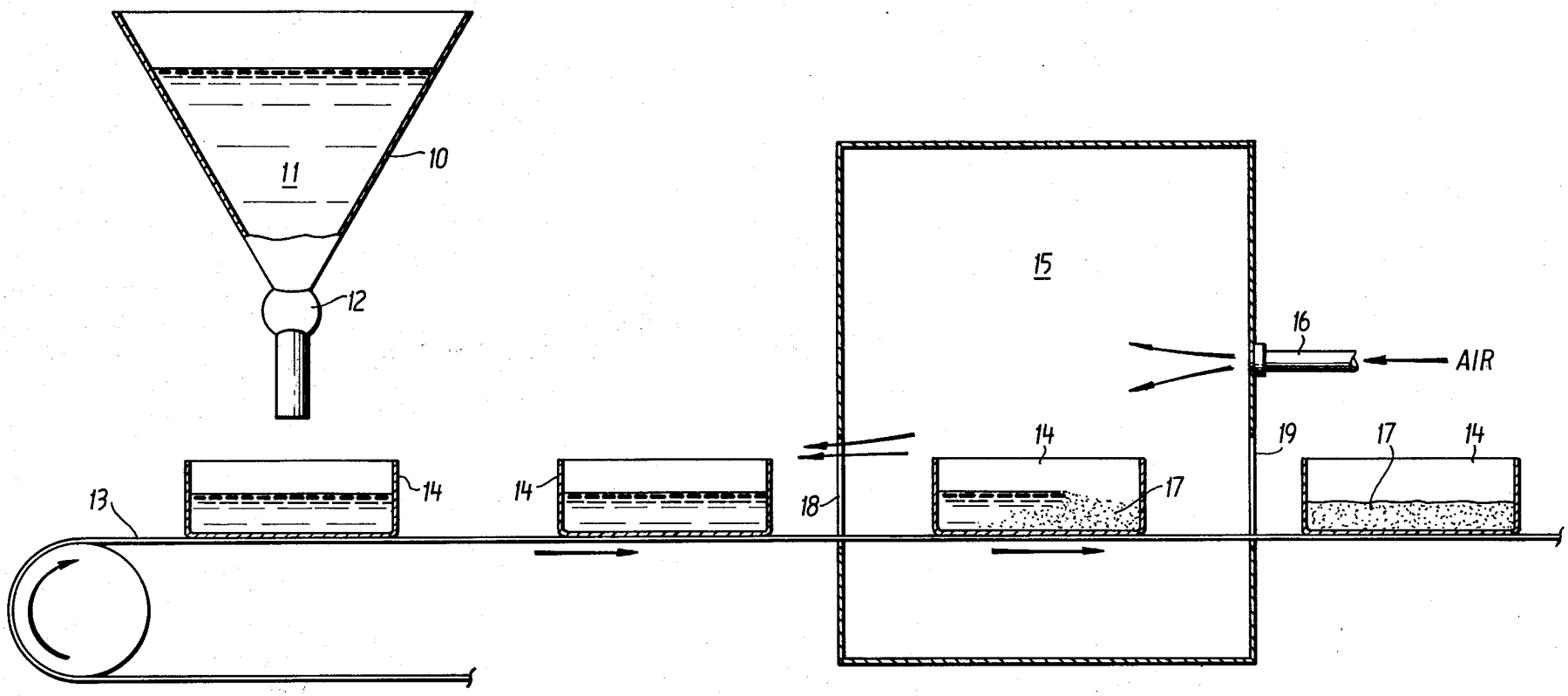
AIR
16
19
14
17
15
14
17
18
14
14
10
11
12
13

METHOD OF PRODUCING CHAR FROM PULP MANUFACTURING WASTE LIQUOR

BACKGROUND OF THE INVENTION

1. Field of the Invention

This invention relates to a method of producing char from concentrated waste liquor expelled from pulp manufacturing plants, which is applicable to all concentrated waste liquor materials generated by the plant.

2. Description of the Prior Art

The quality and properties of activated carbon are directly dependent on the properties of the material. Wood scrap such as saw dust; fruit shells, such as coconut shells; coals, such as bituminous coal, and the like are suitable starting materials for the preparation of activated carbon. However, waste liquor from the pulp manufacturing process is more attractive because such process ensures a large, steady, less expensive supply of starting material.

However, heretofore, no methods have been developed for the production of activated carbon from the waste liquor in the pulp manufacturing process. Only one company has collected unburned carbon from a plant which burns the waste liquor from the pulp manufacturing process and has adopted it as a source of carbon.

Previously, when char for producing activated carbon was produced from the waste liquor in pulp manufacturing, the waste liquor became highly viscous, and resulted in the generation of large lumps of material, so that uniform carbonization of the waste liquor was impossible. This difficulty arose because the lignin and saccharose components of the waste liquor undergo physical and chemical changes at high temperature. This has been a particular problem when rotary kilns have been used as a heat source, because the size of the lumps grows by granulating action as the kiln rotates so that the char cannot be uniformly carbonized. As a result, waste liquor concentrate adheres to the inner wall of carbonizing kilns, and eventually turns into ash. Furthermore, as the components of the waste liquor become molten, the fine pores of the char become closed, which disturbs the next step, that of activating the char, and therefore a high quality char cannot be obtained.

Prior art processes have caused air pollution, since fine dust is generated when the char is produced, and moreover, rotating the waste liquor from pulp manufacturing in kilns spatters and particulates the char which produces the fine dust which causes atmospheric pollution. Though the atmospheric pollution caused by the fine dust can be prevented by using a wet scrubber in the former case, pollution from waste liquor processing remains an unsolved problem.

A need exists, therefore, both from the standpoint of the health of the plant personnel and the elimination of the danger of explosion of the carbon dust to eliminate the fine dust.

SUMMARY OF THE INVENTION

Accordingly, one object of the present invention is to provide a method of producing char from the waste liquor of pulp manufacturing wherein the dense and porous char produced can be converted to activated carbon.

Another object of the present invention is to provide a method of producing char from the waste liquor of pulp manufacturing which may be carbonized without rotating or stirring the waste liquor.

A further object of the present invention is to provide a method of producing char from the waste liquor of pulp manufacturing which will not cause corrosion of the apparatus used in the process and which will not produce gas.

Still another object of the present invention is to provide a method of producing char from the waste liquor of pulp manufacturing which will produce activated carbon in high yield less expensively than the prior art processes.

Briefly, these objects and other objects of the present invention as hereinafter will become more readily apparent from the following description in connection with the accompanying drawing can be attained by a process for producing char from the waste liquor of a pulp manufacturing process by confining the waste liquor in a container and then feeding the container into an air heating furnace in a manner such that the container is contacted countercurrently with heated air without rotating or stirring the container.

DESCRIPTION OF THE PREFERRED EMBODIMENTS

The most important feature of the present invention is that the polluting components of the waste liquor from pulp manufacturing, which include COD (chemical oxygen demand) components, are effectively utilized. The char produced from the waste liquor can be used for the inexpensive production of activated carbon in high yield. Further, the char can also be be combined with the waste liquor to render the liquor less of a problem. Thus, the process of the invention not only produces a useful product, but it also yields a material which eliminates the nuisance value of the waste liquor.

In the present invention, producing char from the waste liquor expelled from pulp manufacturing processes, no chemicals are employed. Further, the carbonization step of the process is conducted at low temperatures, preferably 200° to 400°C, and the process only requires 30 minutes. When the liquor is thus treated, gas is slowly produced by thermal cracking, so that fine air bubbles are uniformly retained in the char which results in a dense and porous char. It is not necessary to further treat the $H_2O$ and $CO_2$ produced by the thermal cracking since these compounds do not represent a pollution problem, but it is necessary to treat the CO and other harmful gases generated utilizing known processes. However, the amount of gases which need to be treated is very small when compared with the amounts formed in the carbonization process at high temperature.

Contrary to the present invention, if the char carbonizing step is performed at high temperature, the amount of gases generated is increased with the results that low quality soft char having large-sized holes is produced in low yield. Further, treatment of this char is difficult and fine dust tends to be produced.

The method of the present invention does not require rotating and stirring of the waste liquor from pulp manufacturing to carbonize the char. If the waste liquor is stirred using a rotary kiln in the conventional manner, the solid components of the waste liquor are converted to large granules or lumps by the caking of the saccharides contained in the waste liquor. The lumps gradually grow to a large size so that only the external surfaces of the solid components are carbonized, while the internal portion thereof remains uncarbonized.

When the waste liquor is poured into a box-shaped container and is maintained without rotating or stirring the container according to the present invention, internal carbonizing skeletons are grown and the entire char will be uniformly carbonized.

One method of collecting the waste liquor from the pulp manufacturing process is to apply the waste liquor dropwise directly to a continuously moving conveyor and solidifying and carbonizing the liquor at a rate which prevents the liquor from flowing outwardly to the periphery of the conveyor. However, an easier and simple technique of confining the waste liquor is to pour the liquor into box-shaped containers or some other suitable container.

The container may be composed of any material which does not adversely affect the char. If a paper or paperboard container is used, the container itself will carbonize, and the char thus produced may be easily treated in a furnace. The shape of the container such as a box-shaped container is selected depending on the shape desired.

Suitable methods of heating the waste liquor include air heating furnaces of the tunnel kiln type. The carbonizing step is conducted by contacting the liquor countercurrently with a heating gas. This countercurrent contact is advantageous in terms of thermal economy and quality control of the char produced as compared with the known concurrent contact methods.

The carbonizing times required in the method of the invention are necessarily long, since the carbonization is conducted at low temperature. However, the times are still short when compared with the carbonization of wood materials. In addition, since the method is continuously performed with a tunnel kiln furnace, high yields of product are produced.

Suitable sources of waste liquor from pulp manufacturing principally include waste sulfite pulp liquor which poses a very troublesome pollution problem and other waste liquors from sulfate, soda, semi-chemical and chemical-grounded pulp.

The char from the waste liquor obtained according to the present invention is converted to activated carbon by the known conventional steam activating process. However, there is no danger, as in prior art processes, that the device used in the conversion process will become corroded, as in the zinc chloride process, or from the presence of corrosive gases such as hydrogen chloride. The activated carbon is obtained in high yield and less expensively than by prior art techniques, and possesses favorable properties.

Having generally described the invention, a more complete understanding can be obtained by reference to certain specific examples, which are included for purposes of illustration only and are not intended to be limiting unless otherwise specified.

EXAMPLE

The analytical values for the waste liquor from a sulfite pulp manufacturing process used in the method of this invention were as follows:

| | |
|---|---|
| Concentration of solid contents: | 53% |
| Specific gravity: | 1.26 |
| pH: | 3.0 |

-continued

| | |
|---|---|
| Total Ca (to solid contents): | 4.0% |
| Total S (to solid contents): | 5.8% |
| Ash (to solid contents): | 8.0% |
| Carbon (to solid contents): | 54.0% |
| Hydrogen (to solid contents): | 6.0% |
| Calorific value: | 4500 kcal/kg (Solid contents) |

Referring to the drawing, the waste liquor 11 from a sulfite pulp manufacturing process was allowed to flow through stopcock 12 from reservoir 10 into container 14 to a depth of 100 mm. The container 14 has the dimensions 800 × 600 mm. This and other containers similarly filled were transported through an air heating furnace 15 of the tunnel kiln-type by conveyor 13. High temperature gases, produced from heavy oil, were introduced into furnace 15 through inlet pipe 16 and countercurrently passed over container 14 thereby converting waste liquor 11 into carbonized solid 17.

The carbonization conditions were as follows:

| | |
|---|---|
| Furnace temperature: | 300°C |
| Retention time: | 40 minutes |
| Exhaust gas temperature: | 200°C |
| Heating gas amount: | 1,500 $NM^3$/hr |

500 kg/hr of char was obtained by the above process. The analytical values of the char thus obtained were as follows:

| | |
|---|---|
| Total Ca: | 8.0% |
| Total S: | 3.8% |
| Ash: | 20.0% |
| Carbon: | 79.0% |
| Hydrogen: | 0.1% |

The char produced above was activated by a steam process known to those skilled in the art. The properties of the activated carbon thus obtained were compared with those of activated carbon produced from saw dust.

The yields of the saw dust activated carbon were obtained from the "Base and its application of new techniques for treating waste liquor by activated carbon" by Dr. Kohei Urano, of Yokohama University, in a conference held at Kanagawa-ken Labor Hall, by the Business Educational Department of the Business Development Center on Mar. 2, 1973. According to this presentation, when activated carbon is produced from saw dust by the known steam activating process, its yield is only about 6%. This may be compared with that of the activated carbon obtained from the char according to the method of the present invention as follows:

| | Activated carbon from the char of the present invention | Commercially available activated carbon derived from wood |
|---|---|---|
| Carbonizing temperature: | 300°C | 600°C |
| Carbonizing yield: | 50% | 25% |
| Activating yield: | 40% | 25% |
| Total Yield: | 20% | 6% |

The results of the comparison of properties of the activated carbon from the char obtained by the method of the present invention with the known, commercially available wood activated carbon are as follows:

| | Activated carbon from the char of the present invention | Commercially available activated carbon derived from wood |
|---|---|---|
| JIS carmel decoloring force: | 92% | 85% |
| JIS methylene blue decoloring force: | 175 ml/g | 121 ml/g |
| Capability for removing COD of Bkp waste liquor: | 750 mg/g | 250 mg/g |
| Capability for decoloring Bkp waste liquor: | 350% | 100% |

As may be seen from these results, the capabilities for removing COD and for decoloring the waste liquor from pulp manufacturing of the activated carbon from the char produced according to the method of the present invention are excellent.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method of producing char from the waste liquor of a pulp manufacturing process, which comprises confining said waste liquor in a container and feeding said container into an air heating furnace in a manner such that said container is contacted countercurrently with heated air without rotating or stirring the container, whereby said waste liquor is solidified and carbonized and wherein the carbonizing temperature is 200° to 400°C and the carbonizing time is more than 30 minutes.

2. The method of claim 1, wherein said confining and feeding steps comprise adding the waste liquor dropwise onto a continuously moving conveyor to solidify and to carbonize said liquor while preventing the waste liquor from flowing out toward the periphery of the conveyor.

3. The method of claim 1, wherein said container is fabricated from box-shaped paper or paperboard.

4. The method of claim 1, wherein said waste liquor is selected from the group consisting of sulfite, sulfate, soda, semi-chemical and chemical-grounded pulp liquors.

* * * * *